US006736034B1

(12) United States Patent
Gonzales

(10) Patent No.: US 6,736,034 B1
(45) Date of Patent: May 18, 2004

(54) LOCKING SOCKET WRENCH DEVICE

(76) Inventor: Scott J. E. Gonzales, 1144 Mary Ann Dr., Atwater, CA (US) 95301

( * ) Notice: Subject to any disclaimer, the term of this patent is extended or adjusted under 35 U.S.C. 154(b) by 0 days.

(21) Appl. No.: 10/299,091

(22) Filed: Nov. 19, 2002

(51) Int. Cl.[7] ..... B25B 23/16
(52) U.S. Cl. ..... 81/177.85; 81/60; 81/177.2
(58) Field of Search ..... 81/177.85, 177.2, 81/60–63.2

(56) References Cited

U.S. PATENT DOCUMENTS

| | | | | |
|---|---|---|---|---|
| 4,733,584 A | | 3/1988 | Karge | |
| 4,817,476 A | | 4/1989 | Karge | |
| 4,848,196 A | * | 7/1989 | Roberts | 81/177.85 |
| 4,962,682 A | | 10/1990 | Rose et al. | |
| 5,214,986 A | | 6/1993 | Roberts | |
| 5,289,745 A | | 3/1994 | Beardsley | |
| 5,343,784 A | * | 9/1994 | Neuhaus | 81/177.85 |
| 5,419,221 A | * | 5/1995 | Cole | 81/60 |
| D419,407 S | | 1/2000 | Davidson | |

* cited by examiner

*Primary Examiner*—D. S. Meislin

(57) ABSTRACT

A locking socket wrench device for locking either the socket to the extension member or to the wrench so that the socket does not unintentionally come off. The locking socket wrench device includes a wrench having an elongate handle portion and a head portion, and also having an opening being disposed through the head portion near an end thereof, and further having a connector member rotatably disposed in the opening and being extended from the head portion; and also includes an extension member being lockingly attachable to the connector member; and further includes a socket being lockingly attachable to either the wrench or the extension member; and also includes an assembly of releaseably locking the extension member and the socket to one another and to the wrench.

10 Claims, 4 Drawing Sheets

LOCKING SOCKET WRENCH DEVICE

BACKGROUND OF THE INVENTION

1. Field of the Invention

The present invention relates to locking socket wrenches and more particularly pertains to a new locking socket wrench device for locking either the socket to the extension member or to the wrench so that the socket does not unintentionally come off.

2. Description of the Prior Art

The use of locking socket wrenches is known in the prior art. More specifically, locking socket wrenches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,733,584; 4,817,476; 4,962,682; 5,214,986; 5,289,745; and Pat. No. Des. 419,407.

While these devices fulfill their respective, particular objectives and requirements, the aforementioned patents do not disclose a new locking socket wrench device. The prior art includes wrenches having shafts, springs, and balls used to connect sockets thereto.

SUMMARY OF THE INVENTION

The general purpose of the present invention, which will be described subsequently in greater detail, is to provide a new locking socket wrench device which has many of the advantages of the locking socket wrenches mentioned heretofore and many novel features that result in a new locking socket wrench device which is not anticipated, rendered obvious, suggested, or even implied by any of the prior art locking socket wrenches, either alone or in any combination thereof. The present invention includes a wrench having an elongate handle portion and a head portion, and also having an opening being disposed through the head portion near an end thereof, and further having a connector member rotatably disposed in the opening and being extended from the head portion; and also includes an extension member being lockingly attachable to the connector member; and further includes a socket being lockingly attachable to either the wrench or the extension member; and also includes an assembly of releaseably locking the extension member and the socket to one another and to the wrench. None of the prior art includes the combination of elements of the present invention.

There has thus been outlined, rather broadly, the more important features of the locking socket wrench device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new locking socket wrench device which has many of the advantages of the locking socket wrenches mentioned heretofore and many novel features that result in a new locking socket wrench device which is not anticipated, rendered obvious, suggested, or even implied by any of the prior art locking socket wrenches, either alone or in any combination thereof.

Still another object of the present invention is to provide a new locking socket wrench device for locking either the socket to the extension member or to the wrench so that the socket does not unintentionally come off.

Still yet another object of the present invention is to provide a new locking socket wrench device that is easy and convenient to set up and use.

Even still another object of the present invention is to provide a new locking socket wrench device that making it easier for the user to use the extension member in hard-to-reach areas without the extension member unintentionally coming off the wrench.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
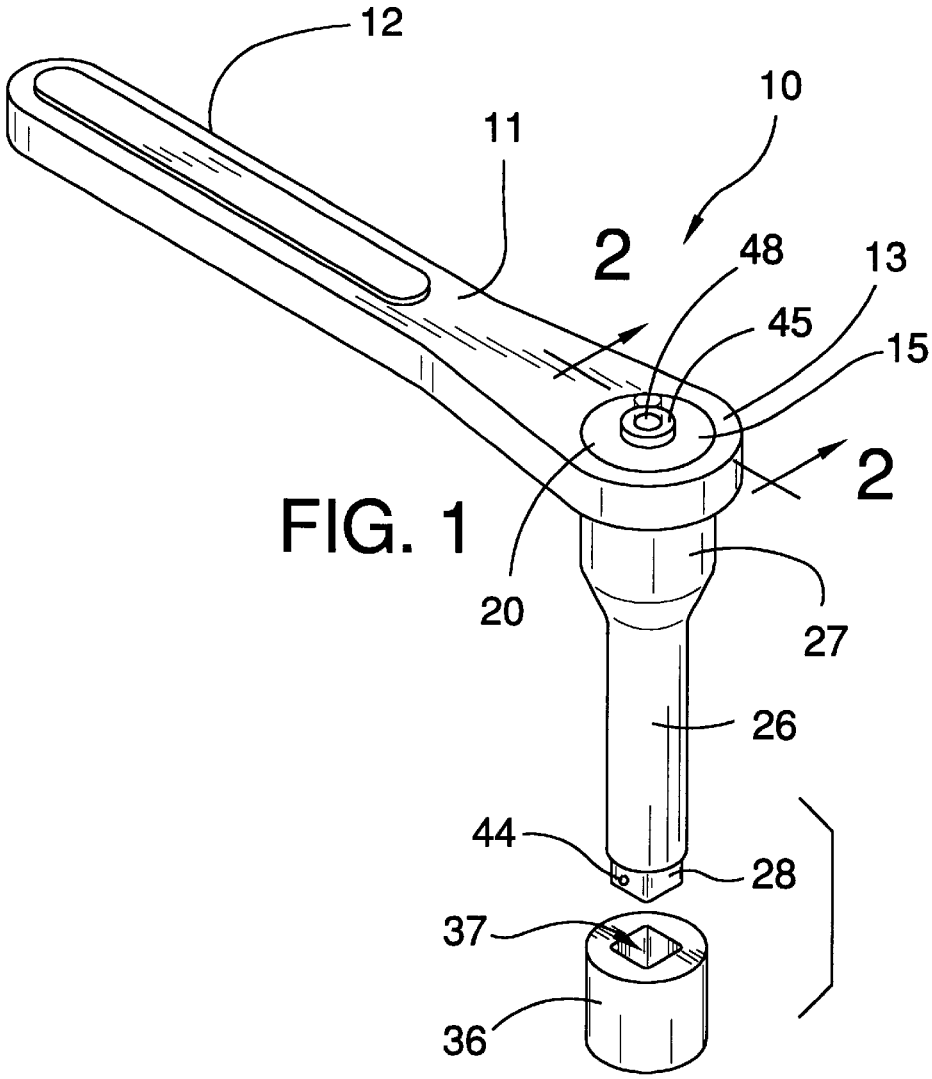
FIG. 1 is a perspective view of a new locking socket wrench device according to the present invention.
Figure 2:
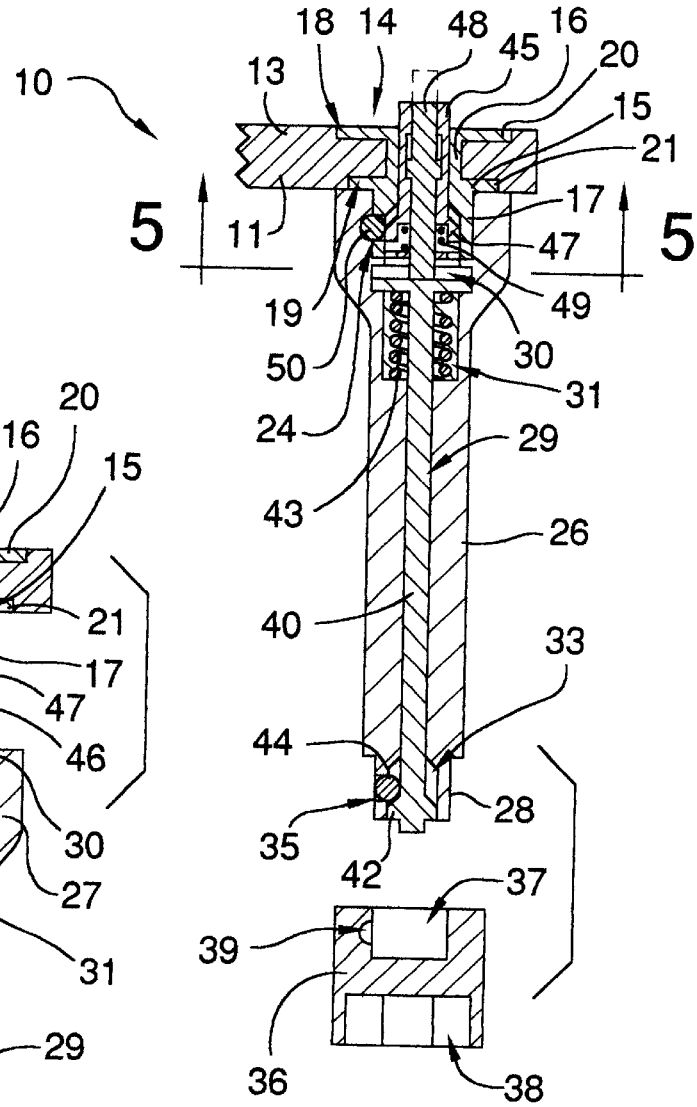
FIG. 2 is a longitudinal cross-sectional view of the present invention.
Figure 4:
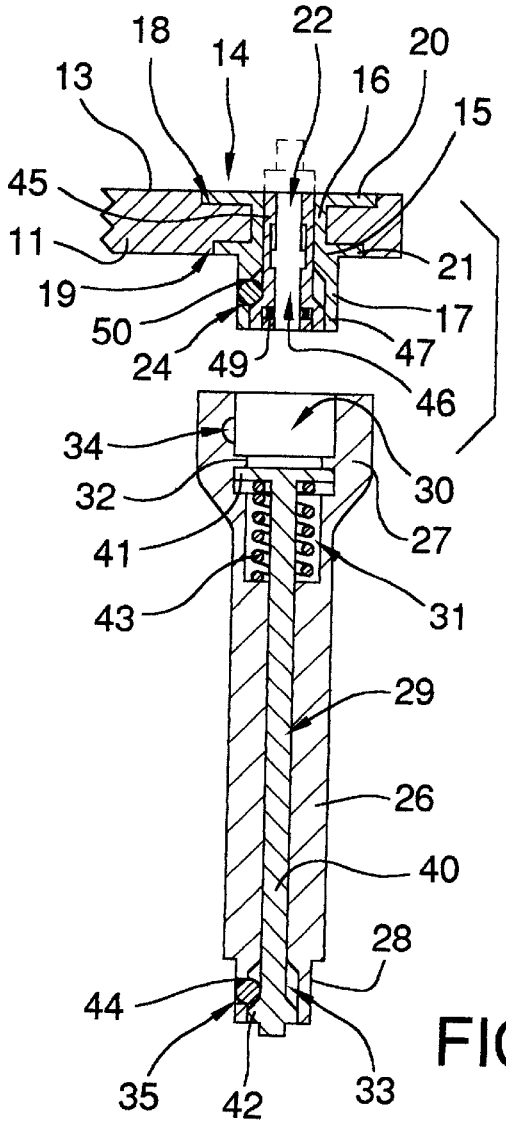
FIG. 4 is another longitudinal cross-sectional view of the present invention.
Figure 3:
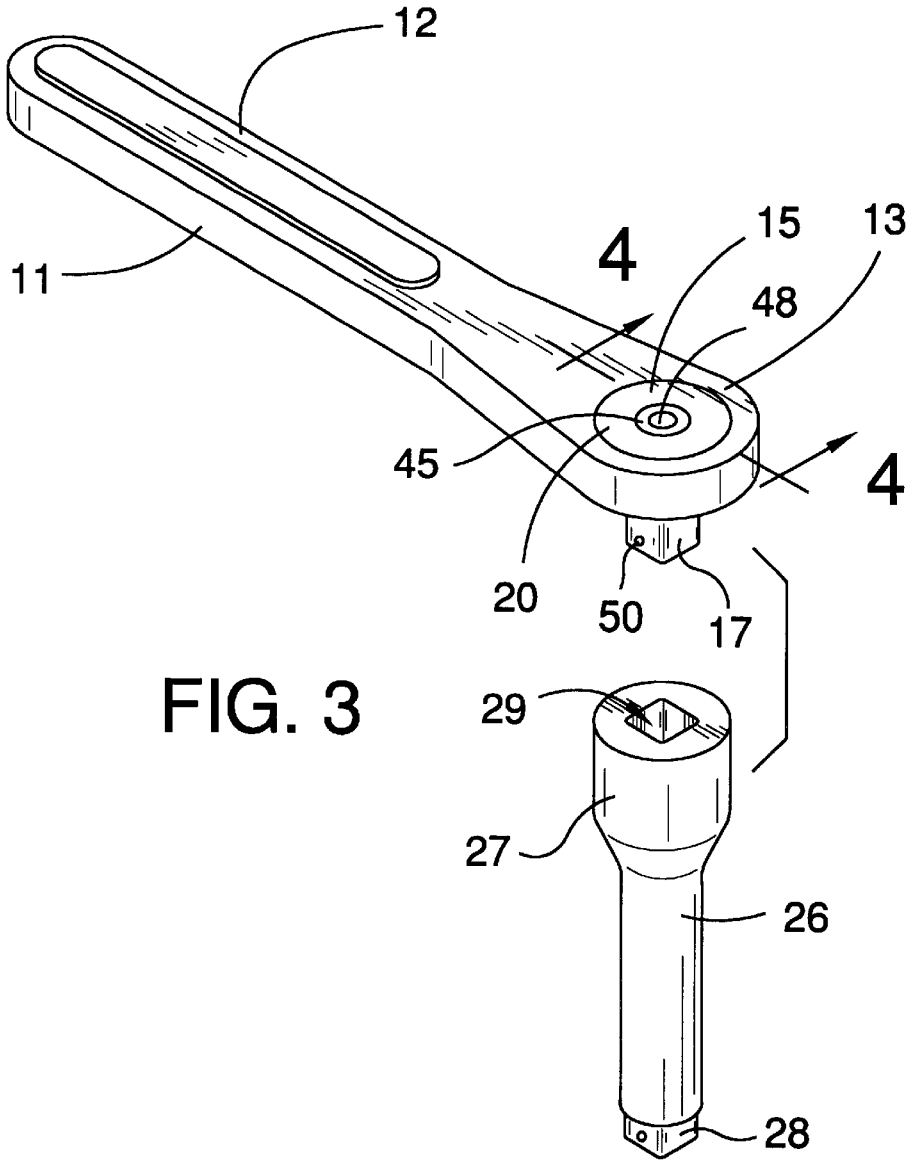
FIG. 3 is an exploded perspective view of the present invention.
Figure 5:
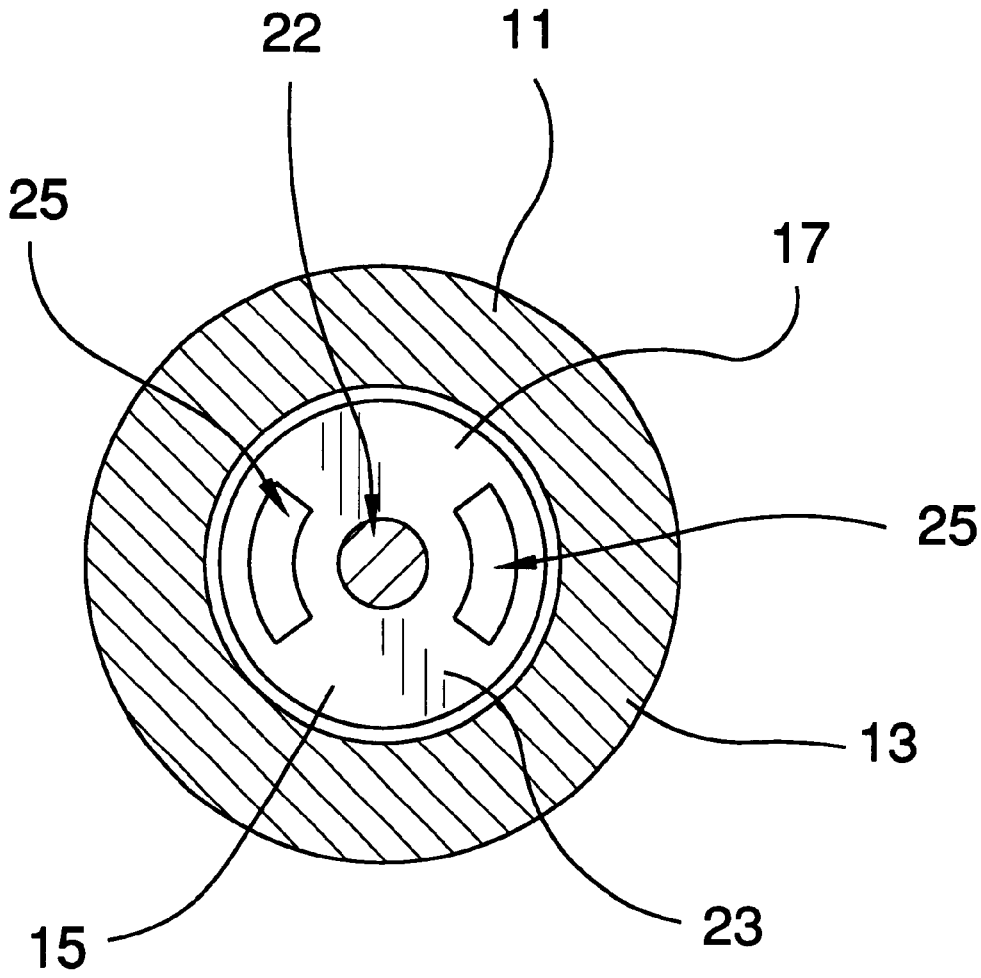
FIG. 5 is a lateral cross-sectional view of the present invention.

With reference now to the drawings, and in particular to FIGS. 1 through 5 thereof, a new locking socket wrench device embodying the principles and concepts of the present invention and generally designated by the reference numeral 10 will be described.

As best illustrated in FIGS. 1 through 5, the locking socket wrench device 10 generally comprises a wrench 11 having an elongate handle portion 12 and a head portion 13, and also having an opening 14 being disposed through the head portion 13 near an end thereof, and further having a connector member 15 rotatably disposed in the opening 14 and being extended from the head portion 13. The head portion 13 has a first side and a second side, and also has annular recessed portions 18,19 being disposed in the first and second sides about the opening 14 which extends through the first and second sides. The connector member 15 includes a body 16,17 having a cylindrical main portion 16 being rotatably disposed in the opening 14 of the wrench 11, and also having a connector portion 17 being extended from the second side of the head portion 13 of the wrench 11, and further having first and second annular flange portions 20,21 being spaced apart and being integrally attached to the cylindrical main portion 16 and being respectively seated in the first and second recessed portions 18,19 of the wrench 11, and also having a bore 22 being disposed through the cylindrical main portion 16 and the connector portion 17, and further having a hole 24 being disposed through a wall of the connector portion 17 and into the bore 22, and also having slots 25 being disposed through an end wall 23 of the connector portion 17 adjacent to the bore 22.

An extension member 26 is lockingly attachable to the connector member 15. The extension member 26 is an elongate tubular member having an enlarged first end portion 27 and a recessed second end portion 28, and also having a bore 29 being disposed therethrough. The bore 29 of the extension member 26 includes an enlarged first end portion 30 being disposed in the enlarged first end portion 27 of the elongate tubular member, and also includes an enlarged intermediate portion 31 being separated from the enlarged first end portion 30 by an annular ledge 32, and further includes an enlarged second end portion 33 being disposed in the recessed second end portion 28 of the elongate tubular member. The extension member 26 further includes a notch 34 being disposed in a side wall of the enlarged first end portion 30 of the bore 29, and also includes a hole 35 being disposed through a wall of the recessed second end portion 28 of the elongate tubular member and into the enlarged second end portion 33 of the bore 29 thereof.

A socket 36 is lockingly attachable to either the wrench 11 or the extension member 26. The socket 36 includes a cylindrical body having a first slot 37 being disposed in a first end thereof, and also having a second slot 38 being disposed in a second end thereof, and further having a notch 39 being disposed in a side wall forming the first slot 37.

A means of releaseably locking the extension member 26 and the socket 36 to one another and to the wrench 11 includes an elongate shaft 40 being movably disposed in the bore 29 of the extension member 26, and also includes a spring 43 being disposed about the elongate shaft 40 in the enlarged intermediate portion 31 of the bore 29 of the extension member 26 for biasing the elongate shaft 40 into a locking position, and further includes a first ball 44 being movably disposed in the hole 35 of the enlarged second end portion 33 of the bore 29 of the elongate tubular member and being removably retained in the notch 39 of the socket to generally lock the socket 36 to the extension member 26, and also includes a connector release member 45 being movably disposed in the opening 14 of the wrench 11, and further includes an extension release member 48 being movably disposed in the connector release member 45 for releasing the socket 36 from the extension member 26, and also includes a spring member 49 for biasing the connector release member 45 into a locking position, and further includes a second ball 50 being movably disposed in the hole 24 of the connector portion 17. The elongate shaft 40 has a first annular flange 41 being integrally disposed about a first end thereof and being disposed in the enlarged intermediate portion 31 of the bore 29 of the extension member 26 with the spring 43 urging against thereof, and also has a second annular flange 42 being integrally disposed about a second end thereof and being disposed in the enlarged second end portion 33 of the bore 29 of the extension member 26 and having a beveled surface to move the first ball 44 into the notch 39 of the socket 36. The connector release member 45 is a tubular stub member having a bore 46 being disposed therethrough and also having an annular flange portion 47 being integrally disposed about a second end thereof and having a beveled surface for moving the second ball 50 into either the notch 34 of the extension member 26 or the notch 39 of the socket 36 with the tubular stub member having end portions being movably disposed in the slots 25 of the end wall 23 of the connector portion 17. The extension release member 48 is a stub shaft being movably disposed in the bore 46 of the tubular stub member and being engagable to the first annular flange 41 of the elongate shaft 40 for moving the elongate shaft 40 to remove the first ball 44 from the notch 39 of the socket 36. The spring member 49 is disposed between the end wall 23 of the connector portion 17 and the tubular stub member for urging the tubular stub member into a locking position in regards to the second ball 50.

In use, the user inserts the connector portion 17 into the enlarged first end portion 30 of the bore 29 of the extension member 26 with the second ball 50 being received in the notch 34 of the extension member 26, and also inserts the recessed second end portion 28 of the extension member 26 into the first slot 37 of the socket 36 with the first ball 44 being received in the notch 39 of the socket 36. To release the extension member 26 from the connector portion 17, the user depresses the connector release member 45 which disengages the second ball 50 and allows the second ball 50 to move out of the notch 34 of the extension member 26, and to release the socket 36 from the extension member 26, the user depresses extension release member 48 which disengages the elongate shaft 40 from the first ball 44 and allows the first ball 44 to move out of the notch 39 of the socket 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the locking socket wrench device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A locking socket wrench device comprising:

a wrench having an elongate handle portion and a head portion, and also having an opening being disposed through said head portion near an end thereof, and further having a connector member rotatably disposed in said opening and being extended from said head portion, said head portion having a first side and a second side, and also having annular recessed portions being disposed in said first and second sides about said opening which extends through said first and second sides, said connector member including a body having a cylindrical main portion being rotatably disposed in said opening of said wrench, and also having a connector portion being extended from said second side of said head portion of said wrench, and further having first and second annular flange portions being spaced apart and being integrally attached to said cylindrical main portion and being respectively seated in said first and second recessed portions of said wrench, and also having a bore being disposed through said cylindrical main portion and said connector portion, and further having a hole being disposed through a wall of said connector portion and into said bore, and also having slots being disposed through an end wall of said connector portion adjacent to said bores;

an extension member being lockingly attachable to said connector member;

a socket being lockingly attachable to either of said wrench or to said extension member; and a means of releaseably locking said extension member and said socket to one another and to said wrench.

2. A locking socket wrench device as described in claim 1, wherein said extension member is an elongate tubular member having an enlarged first end portion and an recessed second end portion, and also having a bore being disposed therethrough.

3. A locking socket wrench device as described in claim 2, wherein said bore of said extension member includes an enlarged first end portion being disposed in said enlarged first end portion of said elongate tubular member, and also includes an enlarged intermediate portion being separated from said enlarged first end portion by an annular ledge, and further includes an enlarged second end portion being disposed in said recessed second end portion of said elongate tubular member.

4. A locking socket wrench device as described in claim 3, wherein said extension member further includes a notch being disposed in a side wall of said enlarged first end portion of said bore, and also includes a hole being disposed through a wall of said recessed second end portion of said elongate tubular member and into said enlarged second end portion of said bore thereof.

5. A locking socket wrench device as described in claim 4, wherein said socket includes a cylindrical body having a first slot being disposed in a first end thereof, and also having a second slot being disposed in a second end thereof, and further having a notch being disposed in a side wall forming said first slot.

6. A locking socket wrench device as described in claim 5, wherein said means of releaseably locking said extension member and said socket to one another and to said wrench includes an elongate shaft being movably disposed in said bore of said extension member, and also includes a spring being disposed about said elongate shaft in said enlarged intermediate portion of said bore of said extension member for biasing said elongate shaft into a locking position, and further includes a first ball being movably disposed in said hole of said enlarged second end portion of said bore of said elongate tubular member and being removably retained in said notch of said socket to generally lock said socket to said extension member, and also includes a connector release member being movably disposed in said opening of said wrench, and further includes an extension release member being movably disposed in said connector release member for releasing said socket from said extension member, and also includes a spring member for biasing said connector release member into a locking position, and further includes a second ball being movably disposed in said hole of said connector portion.

7. A locking socket wrench device as described in claim 6, wherein said elongate shaft has a first annular flange being disposed about a first end thereof and being disposed in said enlarged intermediate portion of said bore of said extension member with said spring urging against thereof, and also has a second annular flange being disposed about a second end thereof and being disposed in said enlarged second end portion of said bore of said extension member and having a beveled surface to move said first ball into said notch of said socket.

8. A locking socket wrench device as described in claim 7, wherein said connector release member is a tubular stub member having a bore disposed therethrough and also having an annular flange portion being disposed about a second end thereof and having a beveled surface for moving said second ball into either said notch of said extension member or said notch of said socket, said tubular stub member having end portions being movably disposed in said slots of said end wall of said connector portion.

9. A locking socket wrench device as described in claim 8, wherein said extension release member is a stub shaft being movably disposed in said bore of said tubular stub member and being engagable to said first annular flange of said elongate shaft for moving said elongate shaft to remove said first ball from said notch of said socket.

10. A locking socket wrench device as described in claim 9, wherein said spring member is disposed between said end wall of said connector portion and said tubular stub member for urging said tubular stub member into a locking position in regards to said second ball.

* * * * *